US009883559B2

(12) United States Patent
Kim et al.

(10) Patent No.: US 9,883,559 B2
(45) Date of Patent: Jan. 30, 2018

(54) LIGHT EMITTING DIODE LIGHTING DEVICE

(71) Applicant: SILICON WORKS CO., LTD., Daejeon (KR)

(72) Inventors: Yong Geun Kim, Suwon-si (KR); Sang Young Lee, Jeonju-si (KR); Ki Chul An, Daegu (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 14/893,291

(22) PCT Filed: May 22, 2014

(86) PCT No.: PCT/KR2014/004589
§ 371 (c)(1),
(2) Date: Nov. 23, 2015

(87) PCT Pub. No.: WO2014/189310
PCT Pub. Date: Nov. 27, 2014

(65) Prior Publication Data

US 2016/0135256 A1 May 12, 2016

(30) Foreign Application Priority Data

May 23, 2013 (KR) ..... 10-2013-0058309

(51) Int. Cl.
*H05B 37/02* (2006.01)
*H05B 33/08* (2006.01)

(52) U.S. Cl.
CPC ..... *H05B 33/083* (2013.01); *H05B 33/0809* (2013.01); *H05B 33/0887* (2013.01)

(58) Field of Classification Search
CPC ..... H05B 33/083; H05B 33/0809; H05B 33/0887; H05B 33/08; H05B 33/0836;
(Continued)

(56) References Cited

U.S. PATENT DOCUMENTS

2009/0251068 A1* 10/2009 Holec ..... F21V 23/005 315/294
2010/0109535 A1* 5/2010 Lin ..... H05B 33/0851 315/149

(Continued)

FOREIGN PATENT DOCUMENTS

CN 102235608 11/2011
JP 2013-98560 5/2013

(Continued)

OTHER PUBLICATIONS

International Search Report for International Application No. PCT/KR2014/004589, dated Sep. 19, 2014.

(Continued)

*Primary Examiner* — Jimmy Vu
*Assistant Examiner* — Henry Luong
(74) *Attorney, Agent, or Firm* — Kile Park Reed & Houtteman PLLC

(57) ABSTRACT

Disclosed is an LED lighting apparatus capable of performing lighting using a rectified voltage. The LED lighting apparatus may include a lamp divided into a plurality of light emitting modules, and perform lighting using a voltage obtained by lowering a rectified voltage, thereby preventing internal parts from being damaged by a surge voltage. Furthermore, the structure in which LED groups are arranged on a substrate can be improved to uniformize the light intensity.

9 Claims, 4 Drawing Sheets

(58) Field of Classification Search
CPC ..... H05B 33/0842; H05B 33/0848; H05B 33/0866; H05B 37/02
USPC ..... 315/122, 185 R, 186, 192, 193, 209 R, 315/225, 291, 294, 307–326, 360
See application file for complete search history.

(56) References Cited

U.S. PATENT DOCUMENTS

| | | | | |
|---|---|---|---|---|
| 2011/0199003 | A1* | 8/2011 | Muguruma | H05B 33/083 315/122 |
| 2013/0049615 | A1* | 2/2013 | Kim | H05B 33/0824 315/191 |
| 2013/0069546 | A1* | 3/2013 | Lin | H05B 33/0812 315/186 |
| 2013/0169160 | A1* | 7/2013 | Kim | H05B 37/02 315/122 |
| 2013/0200796 | A1* | 8/2013 | Song | F21V 23/002 315/113 |
| 2014/0184078 | A1* | 7/2014 | Hwang | H05B 33/083 315/122 |
| 2014/0217909 | A1* | 8/2014 | Chu | H05B 33/0827 315/192 |

FOREIGN PATENT DOCUMENTS

| | | |
|---|---|---|
| KR | 10-2011-0040509 | 4/2011 |
| KR | 10-2011-0060053 | 6/2011 |
| KR | 10-1132408 | 4/2012 |

OTHER PUBLICATIONS

Written Opinion with English Translation of International Application No. PCT/KR2014/004589, dated Sep. 19, 2014.

* cited by examiner

LIGHT EMITTING DIODE LIGHTING DEVICE

TECHNICAL FIELD

The present disclosure relates to an LED lighting apparatus, and more particularly, to an LED lighting apparatus which performs lighting using a rectified voltage.

BACKGROUND ART

According to the recent trend of lighting technology, an LED (Light Emitting Diode) has been employed as a light source.

A high-brightness LED is differentiated from other light sources in terms of various aspects such as energy consumption, lifetime, and light quality.

However, a lighting apparatus using LEDs as a light source may require additional circuits due to the characteristic of the LEDs which are driven by a constant current.

Examples of devices which have been developed to solve the above-described problem may include an AC direct type lighting apparatus.

In general, the AC direct type LED lighting apparatus is designed to drive LEDs using a rectified voltage obtained by rectifying commercial power. The rectified voltage may have a ripple of which the frequency is twice higher than that of the commercial power. Furthermore, each of the LEDs may be designed to have a light emission voltage Vf of 2.8V to 3.8V, for example.

Since the above-described AC direct type LED lighting apparatus directly uses the rectified voltage as an input voltage without using an inductor and capacitor, the AC direct type LED lighting apparatus has a favorable power factor.

The LEDs included in the LED lighting apparatus may be divided into a plurality of LED groups, and the plurality of LED groups may be sequentially turned on or off according to the rises or falls of the rectified voltage having a ripple.

The AC direct type LED lighting apparatus may include a plurality of switching elements (for example, FET) in order to control the turn-on/off of the LEDs. The plurality of switching elements may be configured for the respective LED groups, and the switching operations thereof can be controlled in response to the turn-on/off of the respective LED groups.

For example, when the LED lighting apparatus is designed to use an input voltage of AC 220V, a rectified voltage applied to the LED groups may have a peak voltage of about 311V.

The AC direct type LED lighting apparatus must be designed to be protected from a surge voltage. The surge voltage may be generated by various factors, and introduced into the LED lighting apparatus through an input voltage line.

When the LED groups are driven in the environment where a rectified voltage having a peak voltage of 311V is applied, a surge voltage of about 450V or more may have an influence on internal circuits. In general, the plurality of switching elements included in the LED lighting apparatus are designed to have a withstanding voltage of 450V to 700V. However, when a surge voltage equal to or higher than the designed withstanding voltage is applied, the switching elements may be damaged by the surge voltage. Thus, the conventional LED lighting apparatus may have a problem in terms of reliability.

The LED lighting apparatus may include switching elements capable of enduring a high voltage in order to secure stability from a surge voltage. However, since the switching elements capable of enduring a high voltage are expensive, the above-described method may serve as a factor which increases the manufacturing cost of the LED lighting apparatus.

The AC direct type LED lighting apparatus may be designed in such a manner that the LED group which first emits light among the plurality of LED groups includes a large number of LEDs, in order to prevent waveform distortion of the rectified voltage and to satisfy an operation characteristic (harmonic characteristic).

For example, the lamp of the LED lighting apparatus may include 96 to 104 LEDs, based on the environment in which an input voltage of AC 220V is applied.

The 96 to 104 LEDs may be divided into a plurality of LED groups, and each of the LED groups may include a different number of LEDs.

For example, when the LEDs are divided into four LED groups, the first LED group may include 30 LEDs, and each of the other LED groups may include 23 LEDs.

In this case, since the first LED group includes a larger number of LEDs than the other groups, the first LED group requires a high light emission voltage Vf. More specifically, the first LED group may be designed to require a light emission voltage Vf of 90V, and the other LED groups may be designed to require a light emission voltage Vf of 70V.

In this case, a difference between the light emission voltage Vf of the first LED group and the light emission voltage Vf of the other LED groups may be set to 20V or more. The difference between the light emission voltages Vf may serve as a factor which causes a difference in light intensity between the first LED group and the other LED groups. Furthermore, each of the other LED groups excluding the first LED group may have a low light intensity as the priority of the LED group is low, due to a difference in light emission time therebetween.

The LED lighting apparatus may be implemented with an L-tube having a similar structure to a fluorescent lamp. For this reason, an LED group has a low light intensity as the LED group is remote from the position at which the input voltage is applied. In reality, a difference between the light intensity of the first LED group to which the highest voltage is applied and the light intensity of the last LED group to which the lowest voltage is applied may be set to 70 or less.

Thus, the AC direct type LED lighting apparatus may have difficulties in providing a uniform light intensity (or luminance) at each position of the lamp.

DISCLOSURE

Technical Problem

Various embodiments are directed to an LED lighting apparatus which is capable of preventing the damage of parts in response to a surge voltage, thereby securing the reliability of products.

Also, various embodiments are directed to an LED lighting apparatus which is capable of driving LED groups through an AC direct driving method, and reducing the level at which a surge voltage applied to a switching element can occur, thereby securing the stability of the switching element.

Also, various embodiments are directed to an LED lighting apparatus which is implemented as an L-tube and can provide a uniform light intensity at each position of a lamp thereof.

Technical Solution

In an embodiment, an LED lighting apparatus may include: a power supply unit configured to provide a rectified voltage; and two or more light emitting modules. Each of the light emitting modules may include a plurality of LEDs divided into a plurality of LED groups, the plurality of LED groups may be sequentially turned on/off, and the rectified voltage may be applied across the two or more light emitting modules connected in series.

In an embodiment, an LED lighting apparatus may include: a substrate; a plurality of LEDs divided into first and second rows and arranged on the substrate, wherein the LEDs at each row are connected in series; a first current regulator configured to divide the LEDs included in the first row into a plurality of LED groups and provide a first current path for each of the LED groups at the first row which sequentially emit light according to a rectified voltage; and a second current regulator configured to divide the LEDs included in the second row into a plurality of LED groups and provide a second current path for each of the LED groups at the second row which sequentially emit light according to the rectified voltage transmitted through the first current path of the first current regulator. The first and second current paths may be formed at the same time for light emission of the LED groups corresponding to each other at the first and second rows.

Advantageous Effects

In accordance with the embodiments of the present invention, the LED lighting apparatus has a structure that the plurality of light emitting modules are driven by a rectified voltage lowered by division. Thus, the level of a surge voltage which can be introduced through a voltage input line may be reduced in proportion to the lowered rectified voltage.

As a result, parts such as a switching element for providing a current path for each LED group can be prevented from being damaged by a surge voltage, which makes it possible to secure the reliability of products.

Furthermore, as the arrangement of the LED groups forming the lamp is improved, the LED lighting apparatus can have a uniform light intensity at each position.

MODE FOR INVENTION

Figure 1:
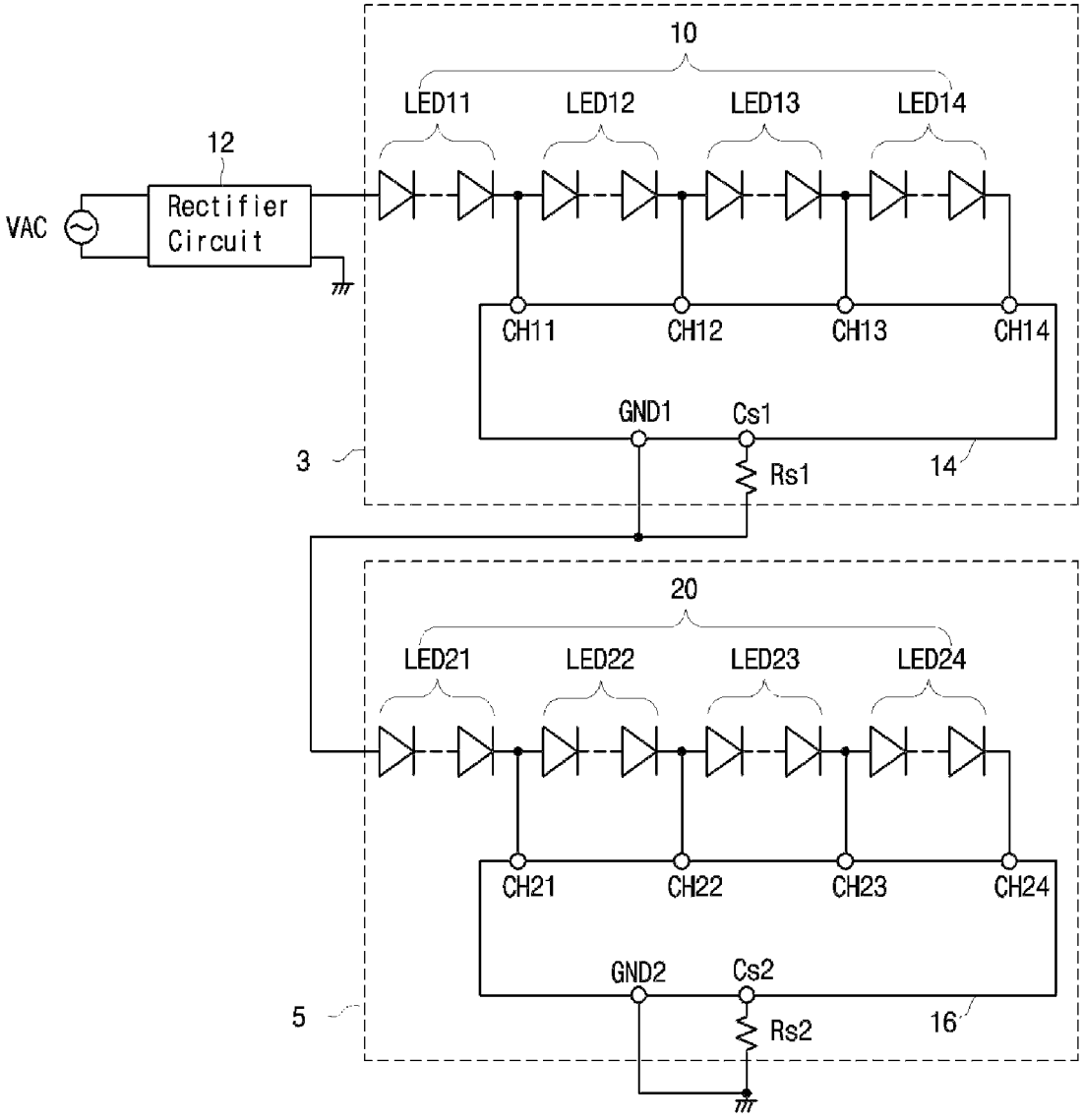
FIG. 1 is a circuit diagram illustrating an LED lighting apparatus in accordance with an embodiment of the present invention.

Hereafter, exemplary embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

The embodiments of the present invention disclose an AC direct type LED lighting apparatus.

As illustrated in FIG. 1, the LED lighting apparatus in accordance with the embodiment of the present invention may include a power supply unit and two or more light emitting modules 3 and 5.

The LED lighting apparatus in accordance with the embodiment of the present invention uses a rectified voltage to perform LED lighting according to an AC-direct driving method. The rectified voltage may indicate a voltage obtained by full-wave rectifying an AC voltage and having a characteristic that the voltage level thereof repetitively rises or falls on a basis of a half cycle of the AC voltage. In the embodiment of the present invention, the rise or fall of the rectified voltage may indicate a rise or fall of the ripple of the rectified voltage.

The power supply unit in accordance with the embodiment of the present invention may provide the rectified voltage obtained by converting the AC voltage. The power supply unit may include an AC power source VAC configured to provide the AC voltage and a rectifier circuit 12 configured to rectify the AC voltage and output the rectified voltage. The AC voltage source VAC may include a commercial power source.

The rectifier circuit 12 may full-wave rectify a sine-wave AC voltage, and output the rectified voltage.

For convenience of description, FIG. 1 illustrates that two light emitting modules 3 and 5 are configured. However, the present invention is not limited thereto, but various numbers of light emitting modules may be provided according to a designer's intention.

The two light emitting modules 3 and 5 may be connected in series to each other. Furthermore, the rectified voltage provided from the power supply unit may be applied across the light emitting modules 3 and 5 connected in series.

Each of the light emitting modules 3 and 5 may include a plurality of LEDs divided into a plurality of LED groups, and the plurality of LED groups may be sequentially turned on/off.

Between the two light emitting modules included in the LED lighting apparatus in accordance with the embodiment of the present invention, the light emitting module 3 may include a lamp 10, a current control unit 14, and a current sensing resistor Rs1. The light emitting module 5 may include a lamp 20, a current control unit 16, and a current sensing resistor Rs2.

The light emitting modules 3 and 5 in accordance with the embodiment of the present invention may have the same structure.

The light emitting modules 3 and 5 may include an equal number of LED groups and an equal number of LEDs for each LED group.

The light emitting modules 3 and 5 may be set in such a manner that the same current is applied to a current path for light emission of the respective LED groups corresponding to the change of the rectified voltage.

The LED groups included in the light emitting modules 3 and 5 may be turned on or off in synchronization with each other.

The light emitting modules 3 and 5 may be set to have different light emission voltages. In this case, the light emitting modules 3 and 5 may be set in such a manner that each of the LED groups has the same division ratio, and the same current is applied to a current path for light emission of LED groups corresponding to each other.

Unlike the above-described configuration, the light emitting modules 3 and 5 may have different structures according to a designer's intention. In this case, each of the light emitting modules 3 and 5 may include a different number of LED groups and a different number of LEDs for each LED group.

The light emitting modules 3 and 5 may be set in such a manner that the LED groups to emit light in response to the changes of the rectified voltage have a difference in current amount therebetween.

Furthermore, the light emitting modules 3 and 5 may be asynchronously turned on and off. In this case, one or more LED groups included in the light emitting modules 3 and 5 may be turned on or off in synchronization with each other.

Furthermore, the light emitting modules 3 and 5 may be set in such a manner that the same current is applied to one or more current paths for light emissions of LED groups corresponding to each other.

The two light emitting modules 3 and 5 may include current sensing resistors Rs1 and Rs2 which are commonly applied to a current path for light emission. The light emitting modules 3 and 5 may be connected in series to each other through the current sensing resistor Rs1.

In the embodiment of the present invention, each of the light emitting modules 3 and 5 may compare a reference voltage and a current sensing voltage and provide a current path, and a voltage formed in the current sensing resistors Rs1 and Rs2 may be used as the current sensing voltage.

The light emitting modules 3 and 5 may include current regulators for providing a current path. The current regulators may include current control units 14 and 16, respectively, and form a current path according to the comparison result between the reference voltage and the current sensing voltage.

The rectified voltage applied from the power supply unit may be divided by the light emitting modules 3 and 5 connected in series.

For example, when the LED lighting apparatus is designed to use an input voltage of AC 220V, the entire peak voltage of the rectified voltage may be set to about 311V. However, when the light emitting modules 3 and 5 are connected in series as illustrated in FIG. 1, the peak voltage may be divided for each of the light emitting modules 3 and 5, and the divided peak voltage of about 156V may be formed in each of the light emitting modules 3 and 5.

Hereafter, referring to FIGS. 1 and 2, the configuration of the light emitting modules 3 and 5 will be described in detail.

As described above, the light emitting modules 3 and 5 may include the lamps 10 and 20, the current control units 14 and 16, and the current sensing resistors Rs1 and Rs2, respectively, which have the same structure.

First, the lamp 10 included in the light emitting module 3 may include a plurality of LEDs which are divided into the plurality of LED groups LED11 to LED14. The LED groups of the lamp 10 may be sequentially turned on/off by a rectified voltage.

FIG. 1 illustrates that the lamp 10 includes four LED groups LED11 to LED14. However, the lamp 10 in accordance with the embodiment of the present invention is not limited thereto, but may include various numbers of LED groups.

Each of the LED groups LED11 to LED14 may include an equal or different number of LEDs, and a dotted line in each of the LED groups LED11 to LED14 in FIG. 1 indicates that illustration of LEDs is omitted.

Among the LED groups LED11 to LED14, the LED group LED11 may be designed to include a larger number of LEDs than the other LED groups LED12 to LED14, in order to prevent waveform distortion of the rectified voltage and to satisfy an operation characteristic (harmonic characteristic).

The current control unit 14 may include a current regulator for performing current regulation for light emissions of the LED groups LED1 to LED4.

The current control unit 14 may be configured to provide a current path for current regulation through the current sensing resistor Rs1.

According to the above-described configuration, the LED groups LED11 to LED14 of the lamp 10 may be sequentially turned on or off in response to rises or falls of the rectified voltage.

When the rectified voltage rises to sequentially reach light emission voltages of the respective LED groups LED11 to LED14, the current control unit 14 may provide current paths for light emission to the respective LED groups LED11 to LED14.

In the current control unit 14, CH11 to CH14 represent terminals for providing a current path to the respective LED groups LED11 to LED14. Furthermore, Cs1 represents a terminal connected to the current sensing resistor Rs (hereafter, referred to as a current sensing resistor terminal), and GND1 represents a ground terminal. The current sensing resistor terminal Cs1 may be connected to the ground terminal GND1 through the current sensing resistor Rs1.

The current control unit 14 may receive a current sensing voltage through the current sensing resistor Rs1. The current sensing voltage may be varied by a current path which is differently formed in the current control unit 14 according to the light emitting states of the respective LED groups in the lamp 10.

Figure 2:
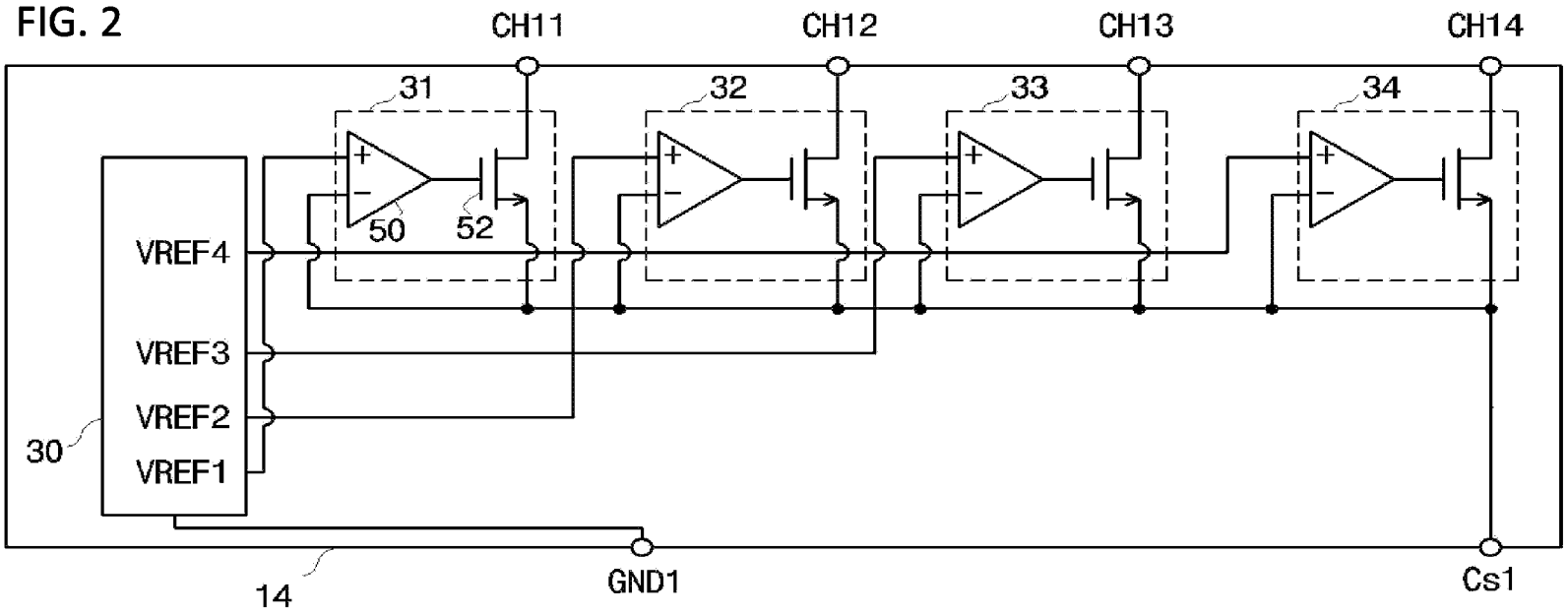
FIG. 2 is a detailed circuit diagram illustrating an example of a voltage regulator of FIG. 1.

The current control unit 14 which performs current regulation in response to a rise of the rectified voltage may be configured as illustrated in FIG. 2.

Referring to FIG. 2, the current control unit 14 may include a plurality of switching circuits 31 to 34 configured to provide current paths for the respective LED groups LED11 to LED14 and a reference voltage supply unit 30 configured to provide reference voltages VREF1 to VREF4.

The reference voltage supply unit 30 may be configured to provide the reference voltages VREF1 to VREF4 having different levels according to a designer's intention.

The reference voltage supply unit 30 may include a plurality of resistors which are connected in series to each other so as to receive a constant voltage, for example. The reference voltage supply unit 30 may output the reference voltages VREF1 to VREF4 having different levels through nodes among the respective resistors. In another embodiment, the reference voltage supply unit 30 may include independent voltage supply sources for providing the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level. The voltage level may gradually increase in order of VREF1, VREF2, VREF3, and VREF4.

The reference voltage VREF1 may have a level for turning off the switching circuit 31 at the point of time that the LED group LED12 emits light. More specifically, the reference voltage VREF1 may be set to a lower level than the current sensing voltage which is formed in the current sensing resistor Rs1 at the point of time that the LED group LED12 emits light.

The reference voltage VREF2 may have a level for turning off the switching circuit 32 at the point of time that the LED group LED13 emits light. More specifically, the reference voltage VREF2 may be set to a lower level than the current sensing voltage which is formed in the current sensing resistor Rs1 at the point of time that the LED group LED13 emits light.

The reference voltage VREF3 may have a level for turning off the switching circuit 33 at the point of time that the LED group LED14 emits light. More specifically, the reference voltage VREF3 may be set to a lower level than the current sensing voltage which is formed in the current sensing resistor Rs1 at the point of time that the LED group LED14 emits light.

The reference voltage VREF4 may be set in such a manner that the current flowing through the current sensing resistor Rs1 becomes a constant current in the upper limit level region of the rectified voltage.

The switching circuits 31 to 34 may be commonly connected to the current sensing resistor Rs1 which provides a current sensing voltage in order to perform current regulation and to form a current path.

The switching circuits 31 to 34 may compare the current sensing voltage of the current sensing resistor Rs1 to the reference voltages VREF1 to VREF4 of the reference voltage supply unit 30, and form a selective current path for turning on the lamp 10.

Each of the switching circuits 31 to 34 may receive a high-level reference voltage as the switching circuit is connected to an LED group remote from the position to which the rectified voltage is applied.

Each of the switching circuits 31 to 34 may include a comparator 50 and a switching element, and the switching element may include an NMOS transistor 52.

The comparator 50 included in each of the switching circuits 31 to 34 may have a positive input terminal (+) configured to receive a reference voltage, a negative input terminal (−) configured to receive a current sensing voltage, and an output terminal configured to output a result obtained by comparing the reference voltage and the current sensing voltage.

The NMOS transistor 52 included in each of the switching circuits 31 to 34 may perform a switching operation according to the output of the comparator 50, which is applied to the gate thereof. The drain of the NMOS transistor 52 and the negative input terminal (−) of the comparator 50 may be commonly connected to the current sensing resistor Rs1.

According to the above-described configuration, the current sensing resistor Rs1 may apply the current sensing voltage to the input terminal (−) of the comparator 50, and provide a current path corresponding to turn-on of any one of the NMOS transistors 52 of the switching circuits 31 to 34.

The light emitting module 3 in accordance with the embodiment of the present invention may be configured as illustrated in FIGS. 1 and 2.

The light emitting module 5 may include the lamp 20, the current control unit 16, and the current sensing resistor Rs2, and have the same structure as the light emitting module 3. Thus, the detailed descriptions for the configuration of the light emitting module 5 are omitted herein.

The lamp 20, the current control unit 16, and the current sensing resistor Rs2 of the light emitting module 5 may correspond to the lamp 10, the current control unit 14, and the current sensing resistor Rs1 of the light emitting module 3, respectively, and have the same structure as those of the light emitting module 3.

However, the light emitting module 5 may be connected in series to the light emitting module 3 through the current sensing resistor Rs1 which forms a current path of the light emitting module 3, and receive a rectified voltage through the current sensing resistor Rs1. The rectified voltage transmitted through the current sensing voltage Rs1 may be applied to the lamp 20.

The lamp 20 of the light emitting module 5 may include four LED groups LED21 to LED24.

In the current control unit 16 of the light emitting module 5, CH21 to CH24 represent terminals corresponding to the respective terminals CH11 to CH14 of the current control unit 14 of the light emitting module 3, Cs2 represents a terminal connected to the current sensing resistor Rs2 (hereafter, referred to as a current sensing resistor terminal), and GND2 represents a ground terminal. The current sensing resistor terminal Cs2 may be connected to the ground terminal GND2 through the current sensing resistor Rs2.

The light emitting module 5 may provide a current path formed through the current control unit 16 and the current sensing resistor Rs2.

The current control unit 16 may receive a current sensing voltage through the current sensing resistor Rs2. The current sensing voltage may be varied by a current path which is differently formed according to the light emitting states of the respective LED groups in the lamp 20. At this time, the current flowing through the current sensing resistor Rs2 may include a constant current.

The LED lighting apparatus in accordance with the embodiment of the present invention may be turned on/off through current regulation for controlling light emissions of the LED groups in the lamps 10 and 20 of the light emitting modules 3 and 5.

The LED groups included in the light emitting module 3 may emit light in order of LED11, LED12, LED13, and LED14 through current regulation of the current control unit 14, and the LED groups included in the light emitting module 5 may emit light in order to LED21, LED22, LED23, and LED24 through current regulation of the current control unit 16.

Figure 3:
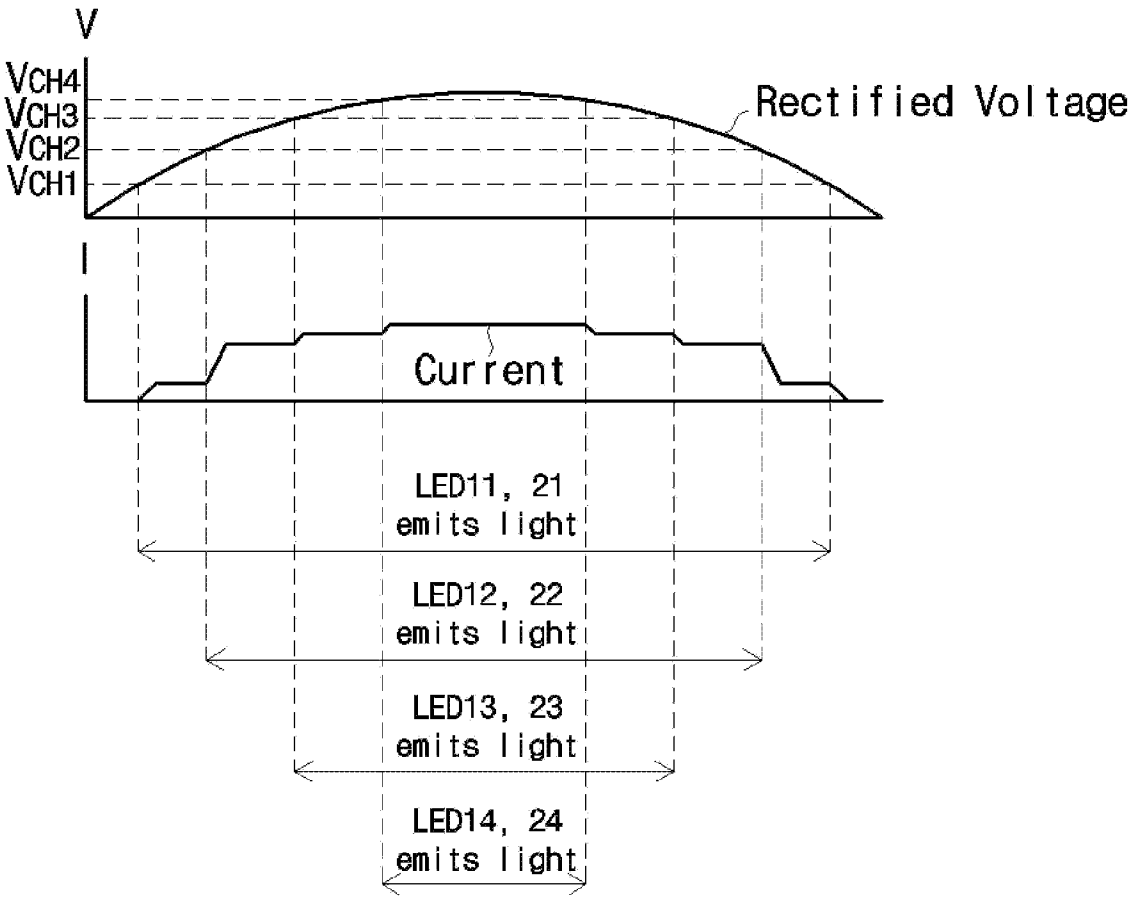
FIG. 3 is a waveform diagram illustrating the operation of the LED lighting apparatus in accordance with the embodiment of the present invention.

The LED groups of the lamps 10 and 20 in accordance with the embodiment of the present invention may be turned on or off synchronously with each other or partially synchronously with each other, in response to a rise or fall of the rectified voltage. That is, as illustrated in FIG. 3, LED group pairs may sequentially emit light in order of (LED11, LED21), (LED12, LED22), (LED13, LED23), and (LED14, LED24).

In order to describe the operation of the LED lighting apparatus in accordance with the embodiment of the present invention, the light emission voltage VCH4 at which the LED groups LED14 and LED24 emit light may be defined as the voltage at which all of the LED groups LED11 to LED14 and LED21 to LED24 emit light, the light emission voltage VCH3 at which the LED groups LED13 and LED23 emit light may be defined as the voltage at which all of the LED groups LED11 to LED13 and LED21 to LED23 emit light, the light emission voltage VCH2 at which the LED groups LED12 and LED22 emit light may be defined as the voltage at which the LED groups LED11, LED12, LED21, and LED22 emit light, and the light emission voltage VCH1 at which the LED groups LED11 and LED21 emit light may be defined as the voltage at which only the LED groups LED11 and LED21 emit light.

The rectified voltage provided from the rectifier circuit 12 may be divided by the light emitting modules 3 and 5 connected in series. As described above, when the LED lighting apparatus is designed to use an input voltage of AC 220V, the entire peak voltage of the rectified voltage may be set to about 311V, and a divided peak voltage of about 156V may be formed in each of the light emitting modules 3 and 5 connected in series.

When the entire peak voltage of the rectified voltage is set to about 311V, the light emission voltage VCH1 may be set to 90V, and the other light emission voltages VCH2 to VCH4 may be set to 70V. Thus, the entire light emission voltage Vf may be set to 300V.

In this case, the LED groups LED11 and LED21 of the light emitting modules 3 and 5 may have a divided light emission voltage of 45V, and the other LED groups LED12, LED13, LED14, LED21, LED22, and LED23 of the light emitting modules 3 and 5 may have a divided light emission voltage of 35V.

That is, the light emission voltages VCH1 to VCH4 may be divided by the light emitting modules 3 and 5. Since the light emitting modules 3 and 5 are designed to have the same structure, the light emission voltage applied to each of the light emitting modules 3 and 5 may be divided in half, compared to the configuration in which one light emitting module is formed.

As the LED light apparatus is configured as described above, a divided rectified voltage of AC 110V may be applied to the light emitting modules 3 and 5 connected in series. As a result, as the peak voltages applied to the respective modules 3 and 5 are set to about 156V, surge voltages which can be generated in the light emitting modules 3 and 5, respectively, may fall to a level of 220V to 230V.

The operation of the LED lighting apparatus based on the current regulation will be described.

When the rectified voltage is in the initial state, the LED groups LED11, LED12, LED13, LED14, LED21, LED22, LED23, and LED24 do not emit light. The current sensing resistors Rs1 and Rs2 may provide a low-level current sensing voltage.

When the rectified voltage is in the initial state, all of the switching circuits 31 to 34 of the current control units 14 and 16 may maintain a turn-on state, because the reference voltages VREF1 to VREF4 applied to the positive input terminals (+) of the respective switching circuits 31 to 34 are higher than the current sensing voltage applied to the negative input terminals (−) of the respective switching circuits 31 to 34.

Although the rectified voltage rises to reach the level at which the LED group LED11 can emit light, no current path is formed in the current control units 14 and 16, because the LED group LED21 does not emit light. Thus, the LED groups LED11 and LED21 may also maintain the turn-off state.

Then, when the rectified voltage reaches the light emission voltage VCH1, the LED group LED11 of the lamp 10 and the LED group LED21 of the lamp 20 may emit light, and a current path for light emission may be provided by the turned-on switching circuits 31 of the current control unit 14 connected to the LED group LED11 and the current control unit 16 of the LED group LED21. The current path of the current control unit 14 of the light emitting module 3 and the current path of the current control unit 16 of the light emitting module 5 may be connected through the current sensing resistor Rs1.

When the rectified voltage reaches the light emission voltage VCH1 such that the LED groups LED11 and LED21 emit light, the levels of the current sensing voltages of the current sensing resistors Rs1 and Rs2 may rise due to the current flow through the switching circuits 31 to provide the current path of the current control units 14 and 16. At this time, since the current sensing voltage has a low level, the turn-on states of the switching circuits 31 to 34 of the current control units 14 and 16 are not changed.

Although the rectified voltage rises to reach the level at which the LED group LED12 can emit light, the light emitting states of the lamps 10 and 20 are not changed because the LED group LED22 does not emit light.

Then, when the rectified voltage continuously rises so that the current of the output terminals of the LED groups LED11 and LED21 increases to exceed the limit value of the current at which the switching circuits 31 of the current control units 14 and 16 can maintain the turn-on state, the current sensing voltages of the current sensing resistors Rs1 and Rs2 may rise to turn off the switching circuits 31 of the current control units 14 and 16. At this time, the input terminal voltages of the LED groups LED12 and LED22 may reach ½ of the light emission voltage VCH2, and the LED groups LED12 and LED22 may emit light using the switching circuits 32 of the current control units 14 and 16 as a current path.

At this time, the LED groups LED11 and LED21 may also maintain the light emitting state.

The switching circuits 31 of the current control units 14 and 16 may be turned off by the level rise of the current sensing voltages of the current sensing resistors Rs1 and Rs2. That is, when the rectified voltage reaches ½ of the light emission voltage VCH2 such that the LED groups LED12 and LED22 emit light, the levels of the current sensing voltages of the current sensing resistors Rs1 and Rs2 may rise due to the current flow through the switching circuits 32 of the current control units 14 and 16 to provide the current path.

At this time, the current sensing voltage may have a higher level than the reference voltage VREF1. Therefore, the NMOS transistor 52 of the switching circuit 31 in each of the current control units 14 and 16 may be turned off by an output of the comparator 50. That is, the switching circuits 31 of the current control units 14 and 16 may be turned off, and the switching circuits 32 of the current control units 14 and 16 may provide a selective current path corresponding to the light emission of the LED groups LED12 and LED22.

Although the rectified voltage rises to reach the level at which the LED group LED13 can emit light, the LED group LED23 does not emit light. Thus, the light emitting states of the lamps 10 and 20 are not changed.

Then, when the rectified voltage continuously rises so that the current of the output terminals of the LED groups LED11 and LED21 increases to exceed the limit value of the current at which the switching circuits 32 of the current control units 14 and 16 can maintain the turn-on state, the current sensing voltages of the current sensing resistors Rs1 and Rs2 may rise to turn off the switching circuits 32 of the current control units 14 and 16. At this time, the input terminal voltages of the LED groups LED13 and LED23 may reach ½ of the light emission voltage VCH3, and the LED groups LED13 and LED23 may emit light using the switching circuits 33 of the current control units 14 and 16 as a current path.

At this time, the LED groups LED11, LED12, LED 21, and LED22 may also maintain the light emitting state.

The switching circuits 32 of the current control units 14 and 16 may be turned off by the level rise of the current sensing voltages of the current sensing resistors Rs1 and Rs2. That is, when the rectified voltage reaches ½ of the light emission voltage VCH3 such that the LED groups LED13 and LED23 emit light, the levels of the current sensing voltages of the current sensing resistors Rs1 and Rs2 may rise due to the current flows through the switching circuits 33 of the current control units 14 and 16.

At this time, the current sensing voltage may have a higher level than the reference voltage VREF2. Therefore, the NMOS transistor 52 of the switching circuit 32 in each of the current control units 14 and 16 may be turned off by an output of the comparator 50. That is, the switching circuits 32 of the current control units 14 and 16 may be turned off, and the switching circuits 33 of the current control units 14 and 16 may provide a selective current path corresponding to the light emission of the LED groups LED13 and LED23.

Although the rectified voltage rises to reach the level at which the LED group LED14 can emit light, the LED group LED24 does not emit light. Thus, the light emitting states of the lamps 10 and 20 are not changed.

Then, when the rectified voltage continuously rises so that the current of the output terminals of the LED groups LED13 and LED23 increases to exceed the limit value of the current at which the switching circuits 33 of the current control units 14 and 16 can maintain the turn-on state, the current sensing voltages of the current sensing resistors Rs1 and Rs2 may rise to turn off the switching circuits 33 of the current control units 14 and 16.

At this time, the input terminal voltages of the LED groups LED14 and LED24 may reach ½ of the light emission voltage VCH4, and the LED groups LED14 and LED24 may emit light using the switching circuits 34 of the current control units 14 and 16 as a current path. At this time, the LED groups LED11, LED12, LED13, LED 21, LED22, and LED23 may also maintain the light emitting state.

The switching circuits 33 of the current control units 14 and 16 may be turned off by the level rise of the current sensing voltages of the current sensing resistors Rs1 and Rs2. That is, when the rectified voltage reaches ½ of the light emission voltage VCH4 such that the LED groups LED14 and LED24 emit light, the levels of the current sensing voltages of the current sensing resistors Rs1 and Rs2 may rise due to the current flows through the switching circuits 34 of the current control units 14 and 16.

At this time, the current sensing voltage may have a higher level than the reference voltage VREF3. Therefore, the NMOS transistor 52 of the switching circuit 33 in each of the current control units 14 and 16 may be turned off by an output of the comparator 50. That is, the switching circuits 33 of the current control units 14 and 16 may be turned off, and the switching circuits 34 of the current control units 14 and 16 may provide a selective current path corresponding to the light emission of the LED groups LED14 and LED24.

Then, although the rectified voltage continuously rises, the switching circuits 34 of the current control units 14 and 16 may maintain the turn-on state, because the reference voltage VREF4 provided to the switching circuits 34 of the current control units 14 and 16 has a higher level than the current sensing voltage formed in the current sensing resistors Rs1 and Rs2 according to the upper limit level of the rectified voltage.

When the LED groups (LED11, LED21), (LED12, LED22), (LED13, LED23), and (LED14, LED24) included in the lamps 10 and 20 of the light emitting modules 3 and 5 sequentially emit light in synchronization with each other in response to the rises of the rectified voltage, the turn-on current corresponding to the light emitting states may increase in a stepwise manner as illustrated in FIG. 3.

That is, since the current control units 14 and 16 perform constant current regulation, the current corresponding to light emission of each LED group may maintain a predetermined level. When the number of LED groups to emit light increases, the level of the current may rise in response to the increase in number of LED groups.

After the rectified voltage rises to the upper limit level as described above, the rectified voltage may start to drop.

When the rectified voltage drops from the upper limit level and falls below the light emission voltage VCH4, the LED groups LED14 and LED24 cannot maintain the light emitting state. At this time, the switching circuits 33 of the current control units 14 and 16 may be turned on by the fall of the current sensing voltages of the current sensing resistors Rs1 and Rs2. Thus, the current path may be formed by the switching circuits 33 of the current control units 14 and 16, the LED groups LED14 and LED24 may be turned off, and the light emitting state may be maintained by the LED groups LED13, LED12, LED11, LED23, LED22, and LED21.

When the LED groups LED14 and LED24 are turned off, the lamps 10 and 20 may maintain the light emitting state through the LED groups LED13, LED12, LED11, LED23, LED22, and LED21. The current path may be formed by the switching circuits 33 of the control units 14 and 16 connected to the LED groups LED13 and LED23.

Then, when the rectified voltage sequentially falls below the light emission voltage VCH3, the light emission voltage VCH2, and the light emission voltage VCH1, the switching circuits 32 and 31 of the current control units 14 and 16 may be sequentially turned on, and the LED groups LED13, LED12, LED11, LED23, LED22, and LED21 of the lamps 10 and 20 may be sequentially turned off.

As the LED groups LED13, LED12, LED11, LED23, LED22, and LED21 of the lamps 10 and 20 are sequentially turned off, the current control units 14 and 16 may provide a selective current path formed by the switching circuits 33, 32, and 31, while shifting the current path. Furthermore, in response to the turn-off states of the LED groups, the level of the turn-on current may also decrease in a stepwise manner.

As described above, the LED lighting apparatus in accordance with the embodiment of the present invention may sequentially turn on/off the LED groups included in the lamps 10 and 20 in response to the rises/falls of the rectified voltage, and control the current regulation and current path formation in response to the turn-on/off of the LED groups.

In the present embodiment configured as illustrated in FIGS. 1 to 3, the LEDs forming the lamps 10 and 20 may be divided and arranged in first and second rows on a substrate 40. The LEDs arranged in each of the rows may be connected in series. The LEDs in the first row may be included in the lamp 10 so as to form the LED groups LED11 to LED14, and the LEDs in the second row may be included in the lamp 20 so as to form the LED groups LED21 to LED24.

The substrate 40 may be formed in a rectangular shape corresponding to the configuration in which the LED lighting apparatus in accordance with the embodiment of the present invention is implemented as an L-tube having a similar structure to a fluorescent lamp. The current control unit 14 serving as a first current regulator and the current control unit 16 serving as a second current regulator may be configured at edges adjacent to both ends of the substrate 40 in the longitudinal direction.

The current control unit 14 serving as the first current regulator may provide a current path for sequentially turning on/off the LED groups LED11 to LED14 of the lamp 10, which are arranged at the first row on the substrate 40, according to a rectified voltage.

The current control unit 16 serving as the second current regulator may provide a current path for sequentially turning on/off the LED groups LED21 to LED24 of the lamp 20, which are arranged at the second row on the substrate 40, according to the rectified voltage.

Figure 4:
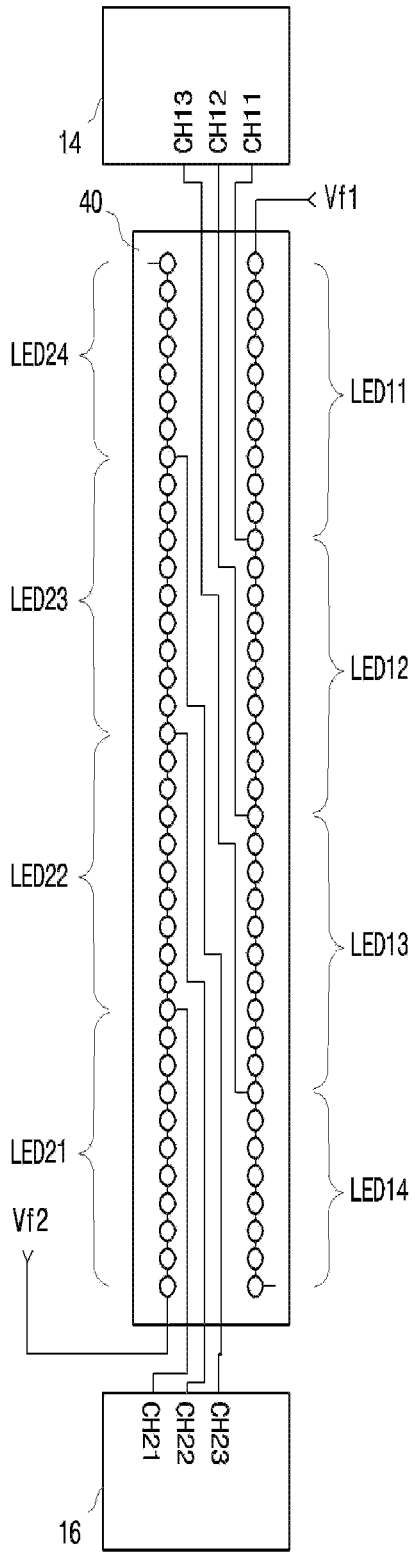
FIG. 4 is a layout diagram illustrating an example in which lamps of FIG. 1 are configured.

FIG. 4 does not illustrate the current sensing resistors Rs1 and Rs2. In FIG. 4, Vf1 represents a rectified voltage provided to the lamp 10 from the rectifier circuit 12, and Vf2 represents a rectified voltage provided to the light emitting module 5 through the current sensing resistor Rs1 from the light emitting module 3.

Referring to FIG. 4, the LEDs included in the lamp 10 along a first longitudinal direction of the substrate 40 may be arranged in order of the LED groups LED11, LED12, LED13, and LED14, and the LEDs included in the lamp 20 along a second longitudinal direction of the substrate 40 may be arranged in order of the LED groups LED21, LED22, LED23, and LED24. The first longitudinal direction is opposite to the second longitudinal direction.

That is, the LED group LED11 of the lamp 10 may be arranged to face the LED group LED24 of the lamp 20, the LED group LED12 of the lamp 10 may be arranged to face the LED group LED23 of the lamp 20, the LED group LED13 of the lamp 10 may be arranged to face the LED group LED22 of the lamp 20, and the LED group LED14 of the lamp 10 may be arranged to face the LED group LED21 of the lamp 20.

In the LED groups of the lamp 10, the light intensity may decrease in order of LED11, LED12, LED13, and LED14. Furthermore, in the LED groups of the lamp 20, the light intensity may decrease in order of LED21, LED22, LED23, and LED24. That is, the LED group LED11 having the highest brightness in the lamp 10 may be arranged to face the LED group LED24 having the lowest brightness in the lamp 20, and the LED group LED14 having the lowest brightness in the lamp 10 may be arranged to face the LED group LED21 having the highest brightness in the lamp 20.

Thus, the LED lighting apparatus in accordance with the embodiment of the present invention can uniformize the light intensity of the entire surface of the substrate 40.

Furthermore, an area required for lines of the substrate can be reduced. That is, a part of lines connected to the LED groups LED11 to LED13 at the first row forming the lamp 10 and a part of lines connected to the LED groups LED21 to LED23 at the second row forming the lamp 20 may be patterned to be arranged on the same line extended in the longitudinal direction. Thus, a space required for the lines of the substrate can be reduced.

More specifically, in order to form three groups included in each of the lamps 10 and 20, a space for forming six rows of lines may be required. However, while the lines connected to each of the lamps 10 and 20 are bent as illustrated in FIG. 4, only a space for four lines may be required. The space may be shared by the four lines.

Thus, the LED lighting apparatus in accordance with the embodiment of the present invention can secure a sufficient space required for the lines, when the lamps 10 and 20 are mounted on the substrate 40 having a limited width in order to implement an L-tube having a similar structure to a fluorescent lamp, which makes it possible to provide flexibility during design.

While various embodiments have been described above, it will be understood to those skilled in the art that the embodiments described are by way of example only. Accordingly, the disclosure described herein should not be limited based on the described embodiments.

The invention claimed is:

1. An LED lighting apparatus comprising:

a power supply unit configured to provide a rectified voltage;

a first light emitting module comprising a first lamp including a plurality of LEDs divided into a plurality of LED groups, a first current control unit configured to provide a first current path for light emission of the first lamp, and a first current sensing resistor applied the first current path; and a second light emitting module comprising a second lamp including a plurality of LEDs divided into a plurality of LED groups, a second current control unit configured to provide a second current path for light emission of the second lamp, and a second current sensing resistor applied the second current path, wherein the rectified voltage is applied across the first lamp, the first current control unit, the first current sensing resistor, the second lamp, the second current control unit, and the second current sensing resistor connected in series, the plurality of LED groups of the first light emitting module and the second light emitting module are respectively sequentially turned on/off, a common current path includes the first current path and the second current path connected in series through the first current sensing resistor and the second lamp, and a first LED group of the first lamp and a second LED group of the second lamp emit light at the same time in response to a predetermined level of the rectified voltage.

2. The LED lighting apparatus of claim 1, wherein the first lamp and the second lamp comprise an equal number of LED groups and an equal number of LEDs for each of the LED groups.

3. The LED lighting apparatus of claim 1, wherein the first lamp and the second lamp comprise a different number of LED groups and a different number of LEDs for each of the LED groups.

4. The LED lighting apparatus of claim 1, wherein the first light emitting module and the second light emitting module are set in such a manner that each of the LED groups emitting light in response to changes of the rectified voltage has the same amount of current.

5. The LED lighting apparatus of claim 1, wherein the first light emitting module and the second light emitting module are set in such a manner that each of the LED groups emitting light in response to changes of the rectified voltage has a different amount of current.

6. The LED lighting apparatus of claim 1, wherein the first LED group included in the first lamp emits light in synchronization with the second LED group included in the second lamp.

7. The LED lighting apparatus of claim 6, wherein the first LED group and the second LED group have the same light emission voltage.

8. The LED lighting apparatus of claim 1, wherein the first current control unit of the first light emitting modules and the second current control unit of the second light emitting module respectively regulate a current of the first current path and the second current according to a comparison result between a reference voltage and a current sensing voltage.

9. An LED lighting apparatus comprising:

a substrate;

a plurality of LEDs divided into first and second rows and arranged on the substrate, wherein the LEDs at each row are connected in series;

a first current regulator configured to divide the LEDs included in the first row into a plurality of LED groups and provide a first current path for each of the LED groups at the first row which sequentially emit light according to a rectified voltage;

a second current regulator configured to divide the LEDs included in the second row into a plurality of LED groups and provide a second current path for each of the LED groups at the second row which sequentially emit light according to the rectified voltage transmitted through the first current path of the first current regulator; and a first sensing resistor for the first current regulator, wherein the first and second current paths are formed at the same time for light emission of the LED groups corresponding to each other at the first and second rows, and the first sensing resistor is included in the first current path, and the rectified voltage is transmitted to the second current regulator through the first sensing resistor.

* * * * *